US009067462B1

(12) United States Patent
Pressler et al.

(10) Patent No.: US 9,067,462 B1
(45) Date of Patent: Jun. 30, 2015

(54) APPARATUS FOR HOLDING AND DRYING PAINT BRUSHES

(71) Applicants: Kurt Terry Pressler, Bethel Island, CA (US); Denise Kathleen Pressler, Bethel Island, CA (US)

(72) Inventors: Kurt Terry Pressler, Bethel Island, CA (US); Denise Kathleen Pressler, Bethel Island, CA (US)

( * ) Notice: Subject to any disclaimer, the term of this patent is extended or adjusted under 35 U.S.C. 154(b) by 0 days.

(21) Appl. No.: 14/568,432

(22) Filed: Dec. 12, 2014

(51) Int. Cl.
*B65D 85/20* (2006.01)
*B44D 3/12* (2006.01)
*A46B 17/02* (2006.01)

(52) U.S. Cl.
CPC ..... *B44D 3/125* (2013.01); *A46B 17/02* (2013.01)

(58) Field of Classification Search
USPC ..... 206/361, 362, 362.3, 15.2, 15.3; 15/104.92; 211/65, 66; 248/110
See application file for complete search history.

(56) References Cited

U.S. PATENT DOCUMENTS

| | | | | | |
|---|---|---|---|---|---|
| 599,744 | A | | 3/1898 | Steinmeyer | |
| 670,481 | A | | 3/1901 | Kirkwood | |
| 1,005,985 | A | | 10/1911 | Lebherz | |
| 1,223,043 | A | | 4/1917 | Draper | |
| 1,566,860 | A | | 12/1925 | Hainzigianis | |
| 1,690,311 | A | | 11/1928 | Reich | |
| 1,892,500 | A | | 12/1932 | Bleckley | |
| 2,121,488 | A | | 6/1938 | Nofz | |
| 2,141,531 | A | * | 12/1938 | Graham | 206/15.2 |
| 2,145,456 | A | | 1/1939 | Oshman et al. | |
| 2,177,504 | A | | 10/1939 | Thompson | |
| 2,415,447 | A | | 2/1947 | Stanton | |
| 2,533,355 | A | * | 12/1950 | Comfort | 211/65 |
| 2,744,635 | A | * | 5/1956 | Hiss | 211/65 |
| 3,327,688 | A | | 6/1967 | Smith | |
| 3,365,761 | A | | 1/1968 | Kalvig | |
| 3,605,160 | A | | 9/1971 | Maurer | |
| 3,881,868 | A | | 5/1975 | Duke | |
| 3,990,755 | A | | 11/1976 | Krause | |
| 4,214,657 | A | | 7/1980 | Winston | |
| 4,305,511 | A | | 12/1981 | Denholtz | |
| 4,538,736 | A | | 9/1985 | Berger | |
| 4,615,456 | A | | 10/1986 | Cousar | |
| 4,627,125 | A | | 12/1986 | Gruns | |
| 4,852,833 | A | * | 8/1989 | Lockwood | 248/110 |
| D304,512 | S | | 11/1989 | Byers et al. | |
| 4,884,701 | A | | 12/1989 | Nymark et al. | |
| 4,905,951 | A | | 3/1990 | Putness | |
| 5,082,119 | A | | 1/1992 | Bingley | |
| 5,097,967 | A | | 3/1992 | Sica | |
| 5,222,610 | A | | 6/1993 | Johansen et al. | |
| 5,242,063 | A | | 9/1993 | Ericksen et al. | |
| D354,989 | S | | 1/1995 | West | |
| 5,645,091 | A | * | 7/1997 | Hoeft | 134/84 |
| 5,799,910 | A | | 9/1998 | Dexter | |
| 5,842,566 | A | | 12/1998 | White | |
| 5,992,912 | A | | 11/1999 | Zimm | |
| 6,022,159 | A | | 2/2000 | Kossnar et al. | |
| 6,135,279 | A | * | 10/2000 | Dryer | 206/362.1 |
| 6,402,104 | B1 | | 6/2002 | Smith | |
| 6,457,592 | B1 | | 10/2002 | Rozen | |
| 7,090,072 | B1 | | 8/2006 | Elliott | |
| 7,234,602 | B2 | | 6/2007 | Roberti | |
| 7,246,709 | B2 | | 7/2007 | Kim | |

(Continued)

*Primary Examiner* — Jacob K Ackun
(74) *Attorney, Agent, or Firm* — Thomas R. Lampe

(57) ABSTRACT

Apparatus for holding and drying paint brushes is utilized with a paint bucket and includes a lid structure including brush handle retention elements for covering the bucket, a base containing liquid absorbent material to absorb paint or other liquids from the paint brushes, and a connector connecting the base and lid structure.

11 Claims, 4 Drawing Sheets

(56) References Cited

U.S. PATENT DOCUMENTS

| | | | | |
|---|---|---|---|---|
| 7,416,080 | B1 * | 8/2008 | Langer | 206/361 |
| 7,984,813 | B1 | 7/2011 | Tapager | |
| 8,286,790 | B1 * | 10/2012 | McBryar | 206/362 |
| 8,567,617 | B1 | 10/2013 | Tapager | |
| 8,720,703 | B1 | 5/2014 | Pressler et al. | |
| 2002/0104771 | A1 | 8/2002 | Young et al. | |
| 2003/0070998 | A1 | 4/2003 | Bulka | |
| 2004/0159752 | A1 | 8/2004 | Vukas | |
| 2006/0180559 | A1 | 8/2006 | Roberti | |
| 2006/0243685 | A1 | 11/2006 | Monroig | |
| 2007/0051647 | A1 * | 3/2007 | Lee | 206/362 |
| 2007/0235395 | A1 | 10/2007 | Mondale et al. | |
| 2011/0108501 | A1 | 5/2011 | Ambrosen | |

* cited by examiner

APPARATUS FOR HOLDING AND DRYING PAINT BRUSHES

TECHNICAL FIELD

This invention relates to apparatus for holding and drying paint brushes.

BACKGROUND OF THE INVENTION

Numerous devices have been proposed for holding various kinds of brushes.

Our U.S. Pat. No. 8,720,703, issued May 13, 2014 discloses apparatus for holding and drying brushes in the form of cosmetic brushes including two brush holder components alternatively connectable to form a first configuration wherein brushes are held with the applicator portions thereof above the handles and a second configuration wherein the applicator portions are below the handles.

The following patent documents are also known and are believed to be additionally representative of the current state of the prior art for holding brushes and in at least some cases for the purpose of drying out the brushes:

U.S. Pat. No. 8,720,703, issued May 13, 2014, U.S. Pat. No. 599,744, issued Mar. 1, 1898, U.S. Pat. No. 670,481, issued Mar. 26, 1901, U.S. Pat. No. 1,005,985, issued Oct. 17, 1911, U.S. Pat. No. 1,223,043, issued Apr. 17, 1917, U.S. Pat. No. 1,566,860, issued Dec. 22, 1925, U.S. Pat. No. 1,690,311, issued Nov. 6, 1928, U.S. Pat. No. 1,892,500, issued Dec. 27, 1932, U.S. Pat. No. 2,121,488, issued Jun. 21, 1938, U.S. Pat. No. 2,145,456, issued Jan. 31, 1939, U.S. Pat. No. 2,177,504, issued Oct. 24, 1939, U.S. Pat. No. 2,415,447, issued Feb. 11, 1947, U.S. Pat. No. 3,327,688, issued Jun. 27, 1967, U.S. Pat. No. 3,365,761, issued Jan. 30, 1968, U.S. Pat. No. 3,605,160, issued Sep. 20, 1971, U.S. Pat. No. 3,881,868, issued May 6, 1975, U.S. Pat. No. 3,990,755, issued Nov. 9, 1976, U.S. Pat. No. 3,990,755, issued Nov. 9, 1976, U.S. Pat. No. 4,214,657, issued Jul. 29, 1980, U.S. Pat. No. 4,305,511, issued Dec. 15, 1981, U.S. Pat. No. 4,538,736, issued Sep. 3, 1985, U.S. Pat. No. 4,615,456, issued Oct. 7, 1986, U.S. Pat. No. 4,627,125, issued Dec. 9, 1986, Design Pat. No. D304,512, issued Nov. 7, 1989, U.S. Pat. No. 4,884,701, issued Dec. 5, 1989, U.S. Pat. No. 4,905,951, issued Mar. 6, 1990, U.S. Pat. No. 5,082,119, issued Jan. 21, 1992, U.S. Pat. No. 5,097,967, issued Mar. 24, 1992, U.S. Pat. No. 5,222,610, issued Jun. 29, 1993, U.S. Pat. No. 5,242,063, issued Sep. 7, 1993, U.S. Design Pat. No. D354,989, issued Jan. 31, 1995, U.S. Pat. No. 5,799,910, issued Sep. 1, 1998, U.S. Pat. No. 5,842,566, issued Dec. 1, 1998, U.S. Pat. No. 5,992,912, issued Nov. 30, 1999, U.S. Pat. No. 6,022,159, issued Feb. 8, 2000, U.S. Pat. No. 6,402,104, issued Jun. 11, 2002, U.S. Pat. No. 6,457,592, issued Oct. 1, 2002, U.S. Pat. No. 7,090,072, U.S. Pat. No. 7,234,602, issued Jun. 26, 2007, U.S. Pat. No. 7,246,709, issued Jul. 24, 2007, U.S. Pat. No. 7,984,813, issued Jul. 26, 2011, U.S. Pat. No. 8,567,617, issued Oct. 29, 2013, U.S. Patent App. Pub. No. 2002/0104771, published Aug. 8, 2002, U.S. Patent App. Pub. No. 2003/0070998, published Apr. 17, 2003, U.S. Patent App. Pub. No. 2004/0159752, Aug. 19, 2004, U.S. Patent App. Pub. No. 2006,0180559, published Aug. 17, 2006, U.S. Patent App. Pub. No. 2006/0243685, published Nov. 2, 2006, U.S. Patent App. Pub. No. 2007/0235395, published Oct. 11, 2007 and U.S. Patent App. Pub. No. 2011/010850, published May 12, 2011.

DISCLOSURE OF INVENTION

The apparatus of this invention differs in a number of respects from the arrangements of the known prior art.

The present invention is for the purpose of holding and drying paint brushes and is employed with commercially available buckets, in particular five gallon plastic paint buckets, to dry and store the paint brushes. The present invention is characterized by its ease of use, effectiveness, and relative simplicity to carry out the storage and drying functions.

The apparatus is for holding and drying paint brushes having a brush handle and a brush applicator portion connected to the brush handle. The apparatus is for connection to a bucket having an upper bucket rim and defining a bucket interior.

The apparatus includes a lid structure including a lid top, a circular lid wall projecting outwardly from the outer periphery of the circular lid wall having bucket rim engagement means.

The lid structure defines a plurality of spaced recesses within the confines of the circular lid wall and further defines openings in communication with the spaced recesses.

The lid structure further includes brush handle retention elements at the spaced recesses for applying frictional forces to paint brush handles received thereby to releasably support the paint brushes.

The apparatus also includes a base and a connector structure connecting the lid structure to the base with the lid structure and the base spaced from one another.

The apparatus includes liquid absorbent material at the base, the base positioned in the bucket interior and disposed below the lid structure when the lid structure is connected to the bucket and covers the bucket interior. The liquid absorbent material is operable to absorb paint or other liquids dripping from paint brushes supported by the lid structure. The lid structure defines air vent openings to promote drying of the paint brushes.

Other features, advantages and objects of the present invention will become apparent with reference to the following description and accompanying drawings.

BEST MODE FOR CARRYING OUT THE INVENTION

Figures 1, 2, 3:
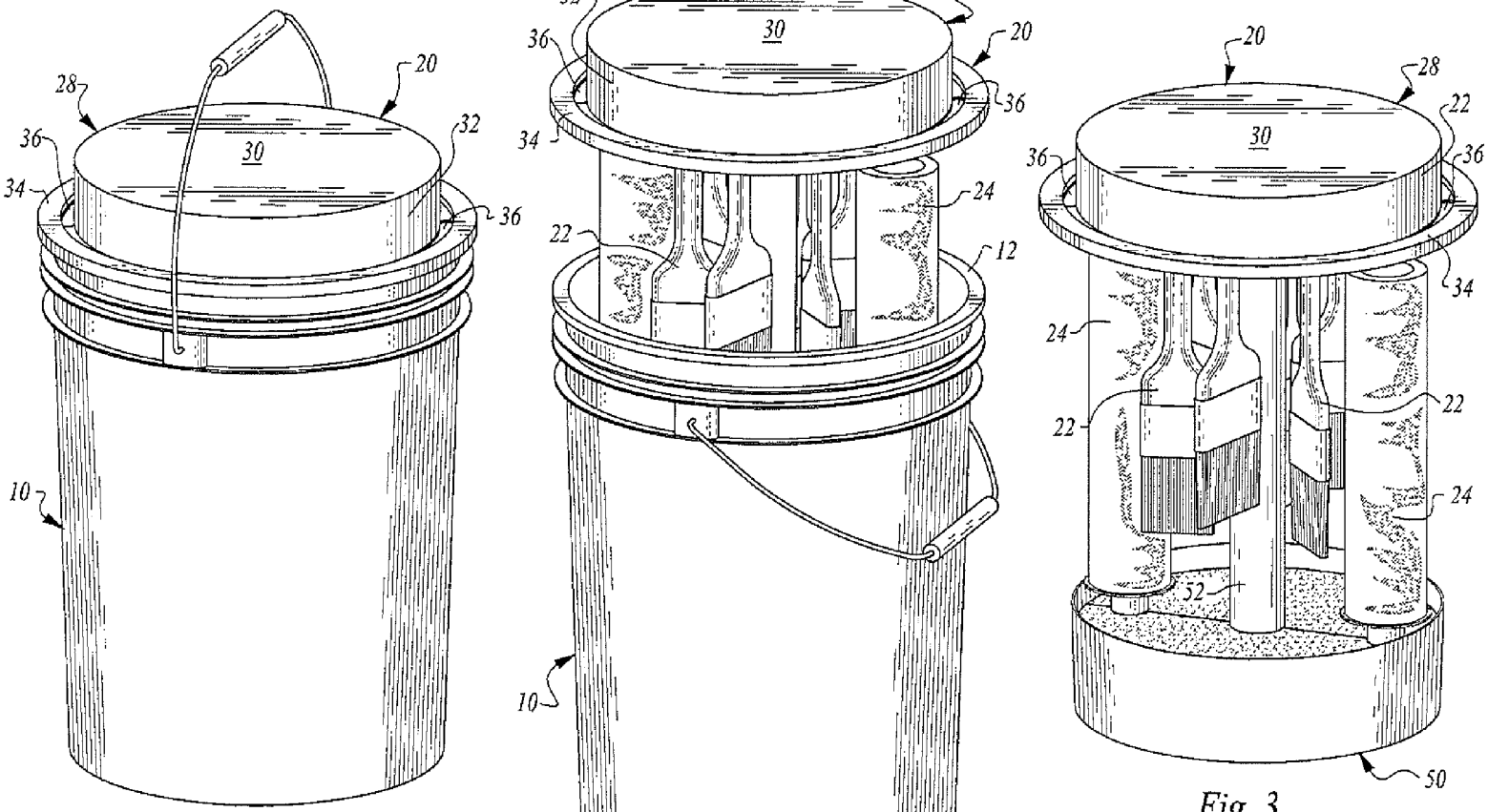
FIG. 1 is a perspective view showing the apparatus of the present invention installed on a conventional five gallon plastic bucket.
FIG. 2 is a perspective view showing the apparatus in the process of either being positioned in the bucket or being removed from the bucket.
FIG. 3 is a perspective view of the apparatus entirely removed from the bucket and holding paint brushes and rollers.
Figures 4, 5, 6:
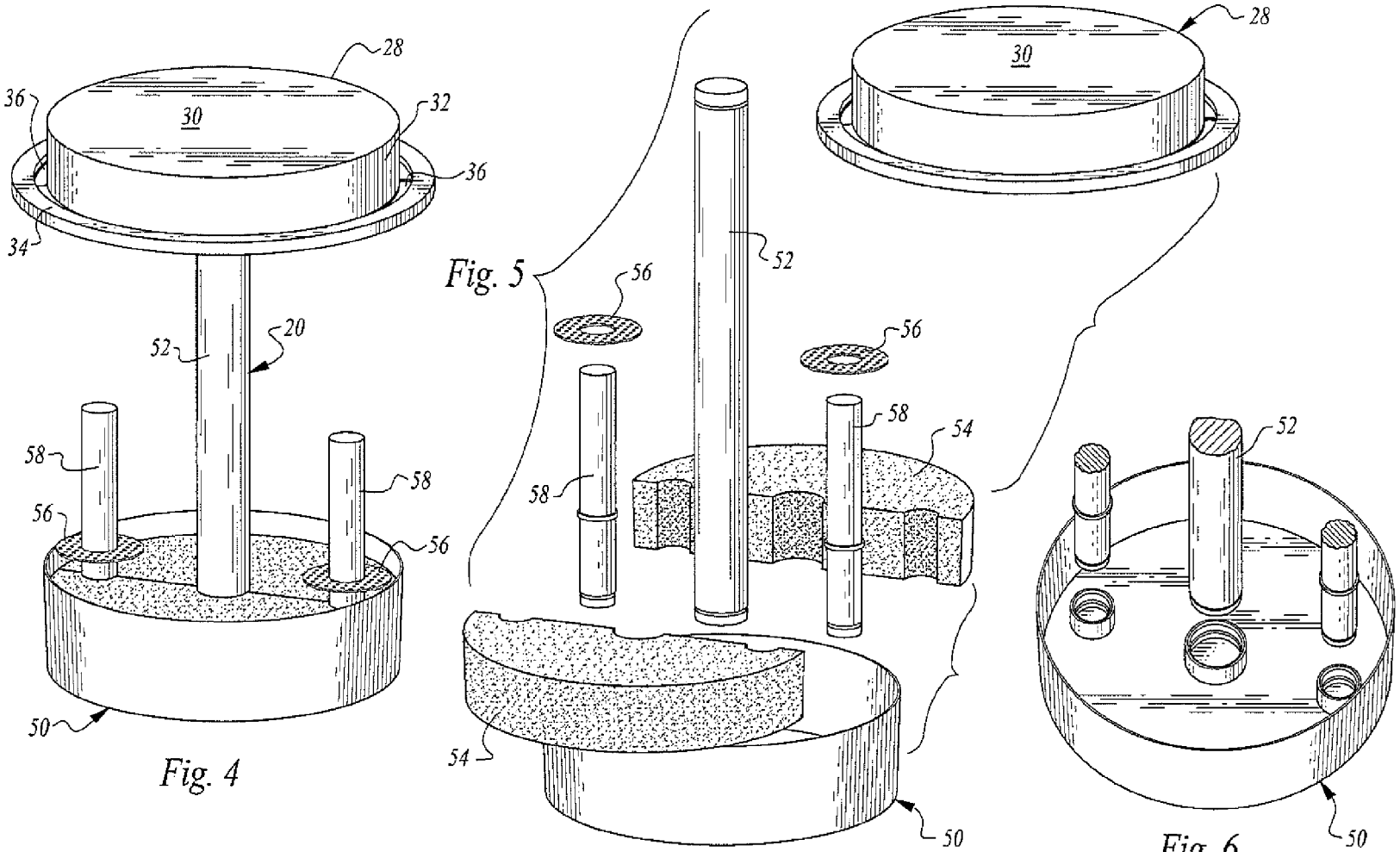
FIG. 4 is a perspective view of the apparatus with the brushes removed therefrom.
FIG. 5 is an exploded, perspective view of the apparatus.
FIG. 6 is a top perspective view illustrating the base of the apparatus and portions of an elongated member and stub shafts of the invention prior to positioning thereof into receptacles formed in the base.
Figure 12:
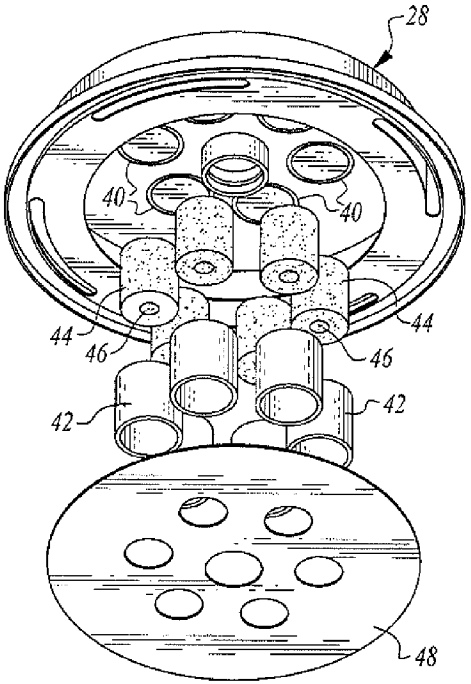
FIG. 12 is an exploded, perspective view illustrating structural components of the lid structure.
Figure 10:
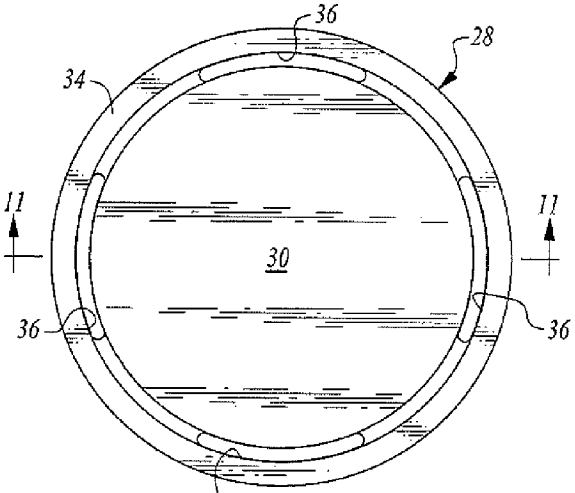
FIG. 10 is a top plan view of the lid structure of the invention.
Figure 11:
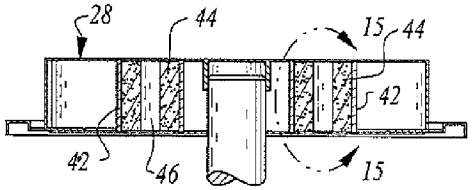
FIG. 11 is a cross-sectional view taken along the line 11-11 in FIG. 10.
Figure 7:
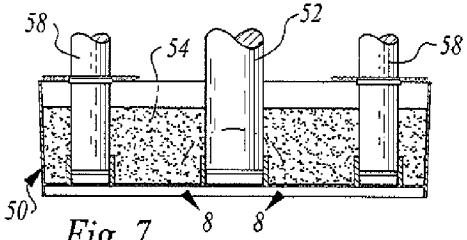
FIG. 7 is a cross-sectional view illustrating the base, portions of the elongated member and stub shafts in the receptacles of the base, and absorbent sponge material in the base interior surrounding the elongated member and stub shafts.
Figure 8:
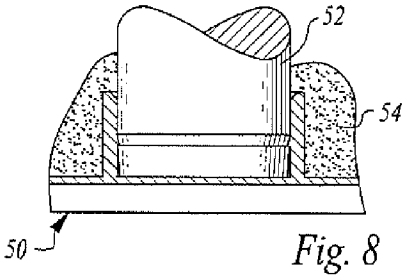
FIG. 8 is an enlarged, cross-sectional view taken along the line 8-8 in FIG. 7.
Figure 9:
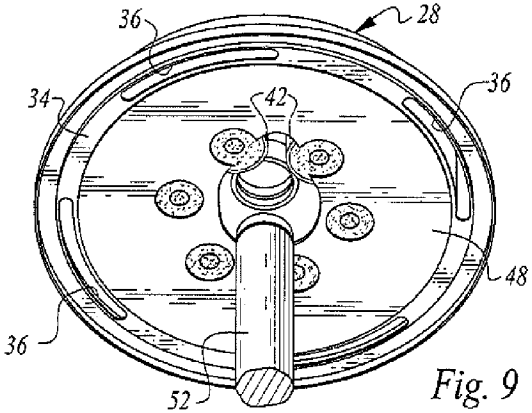
FIG. 9 is a bottom perspective view of the lid structure with portions of the elongated member and lid structure broken away.

Referring now to the drawings, apparatus for holding and drying brushes constructed in accordance with the teachings of the present invention is illustrated. The apparatus is for holding and drying brushes having a brush handle and a brush applicator portion connected to the handle. The apparatus is also utilized for holding and drying paint roller covers. The brushes and paint roller covers illustrated are conventional and the apparatus is particularly suitable for use on any commercially available five gallon plastic bucket such as a paint bucket. The apparatus and bucket can remain attached together during storage. A vent feature allows the contents of the combined bucket and apparatus to dry even if put away in storage.

In the drawings a conventional five gallon plastic paint bucket is designated by reference numeral 10. The bucket has an upper bucket rim 12 and defines a bucket interior.

Apparatus constructed in accordance with the teachings of the present invention is designated by reference numeral 20. The apparatus is for holding and drying paint brushes 22 having a brush handle and a brush applicator portion. The apparatus may also be used to hold and dry paint roller covers 24.

The apparatus 20 includes a lid structure 28 which includes a lid top 30 and a circular lid wall 32 having bucket rim engagement means 34 which is snap fit to the upper bucket rim 12 in a conventional manner.

The bucket rim engagement means 34 defines air vent openings 36.

Lid structure 28 defines a plurality of spaced recesses 40 within the confines of the circular lid wall. The spaced recesses are formed by open ended hollow tubes 42 which also define openings in communication with the spaced recesses.

Figure 15:
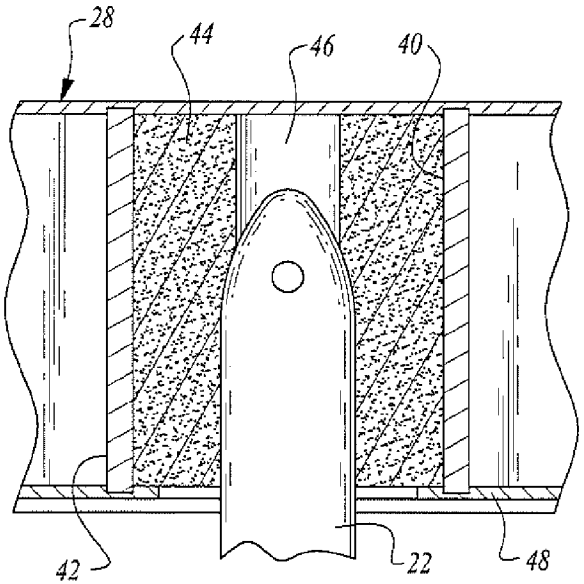
FIG. 15 is a greatly enlarged, cross-sectional view showing the brush handle of a paint brush in drying and storage position, the brush being held by a resilient insert of the lid structure.
Figure 14:
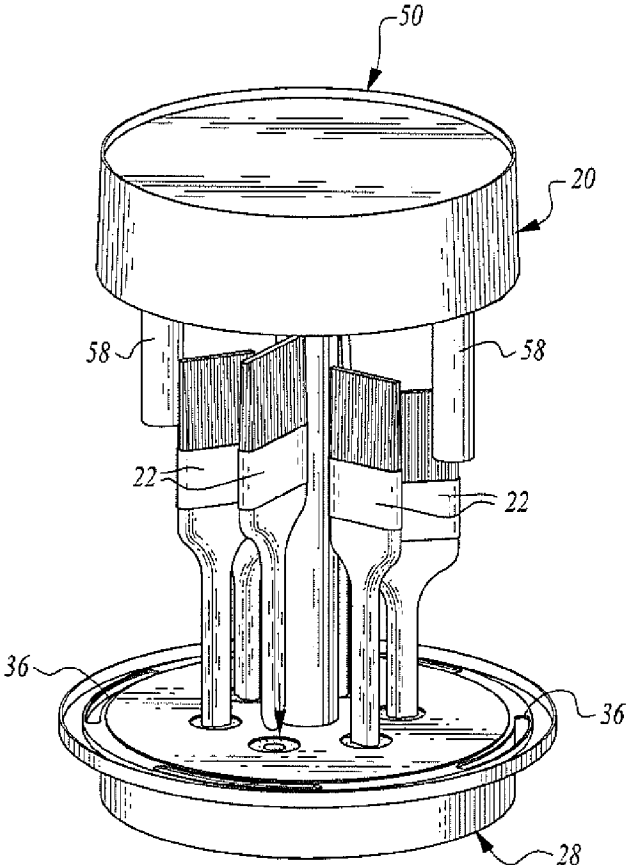
FIG. 14 is a perspective view of the apparatus positioned upside down and brushes extending upwardly from the lid structure, one brush in the process of being installed in place.
Figure 13:
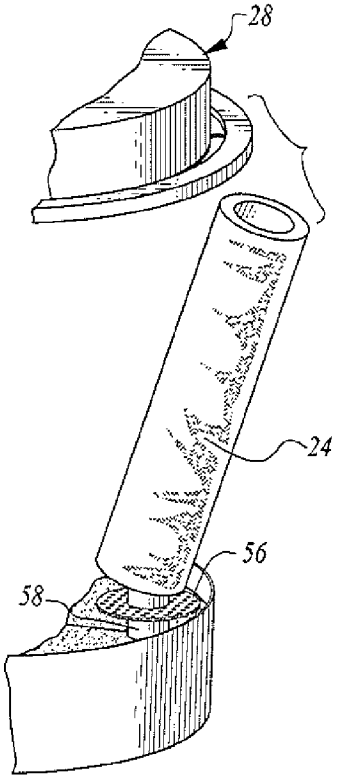
FIG. 13 shows portions of the lid structure and base, a paint roller cover in the process of being positioned on a stub shaft.

Lid structure 28 further includes brush handle retention elements at the spaced recesses 40 for applying frictional forces to brush handles received thereby to releasably support paint brushes. The brush handle retention elements comprise resilient inserts 44 in the spaced recesses. The resilient inserts 44, which may for example be formed of elastomeric foam material, define insert openings 46 for receiving the brush handles. FIG. 15 shows details of a brush handle positioned in a resilient insert 44 and held in a handle up position by the resilient insert 44 by frictional forces applied thereby to the brush handle. A cover plate 48 may be employed to hold the inserts and tubes 42 in place.

The apparatus 20 also includes a base 50. A connector structure in the form of an elongated member or shaft 52 connects the lid structure 28 to the base with the lid structure and the base spaced from one another.

The base 50, the connector structure 52 and the lid structure 28 in the arrangement illustrated are releasably connected together so that they may be disconnected when not in use to form a compact overall structure.

Base 50 defines a base interior, and liquid absorbent material 54 is located in the base interior, being operable to absorb paint or other liquids dripping from paint brushes supported by the lid structure. The liquid absorbent material, which may be of any suitable sponge type or other suitable type of absorbent material, surrounds the elongated member 52. The liquid absorbent material 54 also surrounds two stub shafts 58 which are utilized to hold paint roller covers 24 in a vertical position. Paint or other liquid from the paint roller covers is also absorbed by the liquid absorbent material 54. In the arrangement illustrated, disc-shaped roller cover engagement members 56 are disposed about the stub shafts 58 to be engaged by and support the roller covers 24 when disposed on end.

In the arrangement illustrated, the lid structure 28 has multiple parts. However, the lid structure may suitably be formed as one piece. Also, of course, the lid structure, the base and the elongated member may be permanently connected together rather than separately connected as shown.

Among the advantages of the present invention is that it can be used on any commercially available five gallon paint bucket of plastic or other material. The air vent openings in the lid structure allow contents to dry even if put away in storage. The absorbent material in the base ensures that there is no spillage of liquid even if the bucket is knocked over.

The invention claimed is:

1. Apparatus for holding and drying paint brushes having a brush handle and a brush applicator portion connected to said brush handle, said apparatus for connection to a bucket having an upper bucket rim and defining a bucket interior, said apparatus comprising, in combination:

a lid structure including a lid top, a circular lid wall projecting outwardly from the outer periphery of said lid top and having bucket rim engagement means, said lid structure defining a plurality of spaced recesses within the confines of said circular lid wall and further defining openings in communication with said spaced recesses, said lid structure further including brush handle retention elements at said spaced recesses for applying frictional forces to brush handles received thereby to releasably support paint brushes;

a base;

a connector structure connecting said lid structure to said base with said lid structure and said base spaced from one another; and liquid absorbent material at said base, said base positioned in the bucket interior and disposed below said lid structure when said lid structure is connected to said bucket and covers said bucket interior, said liquid absorbent material operable to absorb paint or other liquids dripping from paint brushes supported by said lid structure, and said lid structure defining air vent openings to promote drying of said paint brushes.

2. The apparatus according to claim 1 wherein said air vent openings are defined by said bucket rim engagement means.

3. The apparatus according to claim 1 wherein said connector structure comprises an elongated member extending between said base and said lid structure.

4. The apparatus according to claim 3 wherein said base defines a base interior and wherein said liquid absorbent material is absorbent sponge material in said base interior and surrounding said elongated member.

5. The apparatus according to claim 1 additionally including paint roller brush supports extending upwardly from said base and said liquid absorbent material.

6. The apparatus according to claim 5 wherein said paint roller brush supports comprise spaced stub shafts and roller brush engagement members disposed about said stub shafts over said liquid absorbent material.

7. The apparatus according to claim 1 wherein said brush handle retention elements comprise resilient inserts in said spaced recesses, said resilient inserts defining insert openings for receiving said brush handles.

8. The apparatus according to claim 7 wherein said resilient inserts are formed of elastomeric foam material.

9. The apparatus according to claim 1 wherein said lid structure, said base and said connector structure are releasably connected together.

10. The apparatus according to claim 7 wherein said lid structure includes spaced, open ended hollow tubes holding said resilient inserts.

11. The apparatus according to claim 1 sized and configured to attach to a five gallon plastic paint bucket.

* * * * *